US007018471B2

(12) United States Patent
Duwendag et al.

(10) Patent No.: US 7,018,471 B2
(45) Date of Patent: Mar. 28, 2006

(54) GLUE METERING IN A PASTE UNIT

(75) Inventors: Ruediger Duwendag, Lengerich (DE); Guido Kerres, Muenster (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/721,890

(22) Filed: Nov. 26, 2003

(65) Prior Publication Data

US 2004/0103990 A1 Jun. 3, 2004

(30) Foreign Application Priority Data

Nov. 27, 2002 (DE) ..... 102 55 484

(51) Int. Cl.
*B05C 1/08* (2006.01)
*B05D 1/28* (2006.01)

(52) U.S. Cl. ..... 118/244; 118/261; 118/262; 427/428.01; 427/428.14

(58) Field of Classification Search ..... 427/428, 427/207.1, 428.01, 428.14; 118/244, 261, 118/262; 156/578
See application file for complete search history.

(56) References Cited

U.S. PATENT DOCUMENTS 4,378,390 A * 3/1983 Yoshida et al. ..... 427/428
5,858,091 A 1/1999 Feldkamper et al.
5,972,167 A * 10/1999 Hayasaka et al. ..... 162/135

FOREIGN PATENT DOCUMENTS

DE 1 123 549 2/1962
DE 195 32 582 9/1995
EP 0 362 423 4/1990

* cited by examiner

*Primary Examiner*—Laura Edwards
(74) *Attorney, Agent, or Firm*—Jacobson Holman PLLC

(57) ABSTRACT

A paste unit and method of glue metering therein for a bottom guide device for star seal bottom bags, which are formed from tube sections, for gluing of bottom warps or star seal bottom bags. The paste unit includes a glue reservoir, a metering roller connected with the glue reservoir, a glue application roller which may be connected to the glue reservoir and a making roller connected to the glue application roller which transfers glue from the application roller to the bottom warps or the star seal bottoms. Drive mechanisms assigned to the above listed rollers enable the circumference speed of the glue application roller and of the making roller to be adjusted independently of one another.

11 Claims, 1 Drawing Sheet

GLUE METERING IN A PASTE UNIT

BACKGROUND OF THE INVENTION

1. Field of the Invention

The invention relates to a paste unit for a bottom buide device for star seal bottom bags having a glue reservoir or glue source, a metering roller connected with the glue reservoir, a glue application roller which may be connected to the glue reservoir or glue source, a making roller connected to the glue application roller for transferring clue from the application roller to the bottom warps or the star seal bottoms, and drive mechanisms assigned to the above listed rollers.

2. Description of the Related Art

Such paste units are known, for example; from patent specification DE 195 32 582. A paste unit of the known type consists of at least one metering roller and one glue application roller, which are connected to a glue reservoir that is embodied as a housing. The metering roller has the same direction of rotation as the glue application roller so that, in this function, it may also be referred to as a sealing roller. The glue absorbed by the glue application roller is removed by the printing roller or the making roller, and transferred by the same to the workpiece to be glued. The metering roller and the glue application roller are driven by means of a mutual toothed belt, which is set into motion by a toothed belt disk.

The amount of glue to be transferred is determined by the gap predetermined by the distance between the metering roller and the glue application roller. For example, if no glue is to be transferred, the gap between the two rollers is closed. The larger the gap is chosen, the more glue is transferred to the making roller and from the same to the workpiece to be glued. The setting of the distance occurs, for example, from a piston cylinder unit by means of a mechanical leverage.

Such engineering mechanics, however, have the disadvantage that they are costly and prone to contamination, which may be caused by the glue. Furthermore, the changes of the glue application amounts cannot be adjusted precisely enough.

SUMMARY OF THE INVENTION

Therefore, the task of the invention is to recommend a device that enables the metering of the glue amount to be applied without using any engineering mechanics for the distance control, and that also possesses a high degree of sensitivity in controlling the glue amount control.

According to the invention, this task is solved by a paste unit having a glue reservoir, a metering roller connected with the glue reservoir, a glue application roller which may be connected to the glue reservoir or glue source, a making roller connected to the glue application roller for transferring glue from the application roller to the bottom warps or the star seal bottoms, and drive mechanisms assigned to the above listed rollers, in which the circumference speeds of the glue application roller and of the making roller or the printing roller can be adjusted independently of one another. In this manner, the ratio of the circumference speeds of both rollers can be selected freely.

Tests have shown that a larger amount of glue can be transferred from the glue application roller to the making roller, if the circumference speed of the glue application roller is increased. Analogously, the circumference speed of the glue application roller is reduced, if a smaller amount of glue is to be applied.

It is beneficial to also adjust the circumference speed of the metering roller independently of the two other rollers, because this has a sealing effect, as described in the introduction. This sealing effect can be influenced by means of the suitable selection of the circumference speed.

It is particularly beneficial, if the direction of rotation of the sealing roller can additionally be reversed.

In a particularly preferred embodiment of the invention, at least one of the three rollers assigned to the paste unit has its own drive.

It is beneficial that at least one of the said rollers has its own drive motor, which is supplied with current by a power electronic power source.

In an especially preferred embodiment of the invention, the said drive means are controlled via a control device. The control device has a data processor, which, depending on the desired glue application amount, or on the desired change of glue application amount, adjusts the circumference speeds of the rollers involved in the glue transport, and aligns them with one another.

It is of particular advantage if the control device starts with a pre-adjusted circumference speed of the making roller in the adjustment and the alignment of the circumference speeds of the rollers.

In this case, the control device may then, for example by means of multiplication with a pre-adjusted ratio between the circumference speeds, control the speed of at least one additional roller.

The invention further includes a method for controlling the glue amount of a paste unit of a bottom guide device for star seal bottom bags, whereby the paste unit glues bottom warps, valve beams, or star seal bottoms, and has at least one glue reservoir and/or a glue source, a metering roller that is connected to the glue reservoir, a glue application roller, which may be connected to the glue reservoir or the glue source, a making roller, which takes off glue from the glue application roller and feeds it to the workpieces to be glued and whereby drive means are assigned to the said rollers. The method according to the invention has the characteristic that the ratio of the circumference speeds of the glue application roller and the making roller is varied for controlling the glue application amount.

Additional embodiment examples of the invention are included in the subject description and the claims.

The individual figures show:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
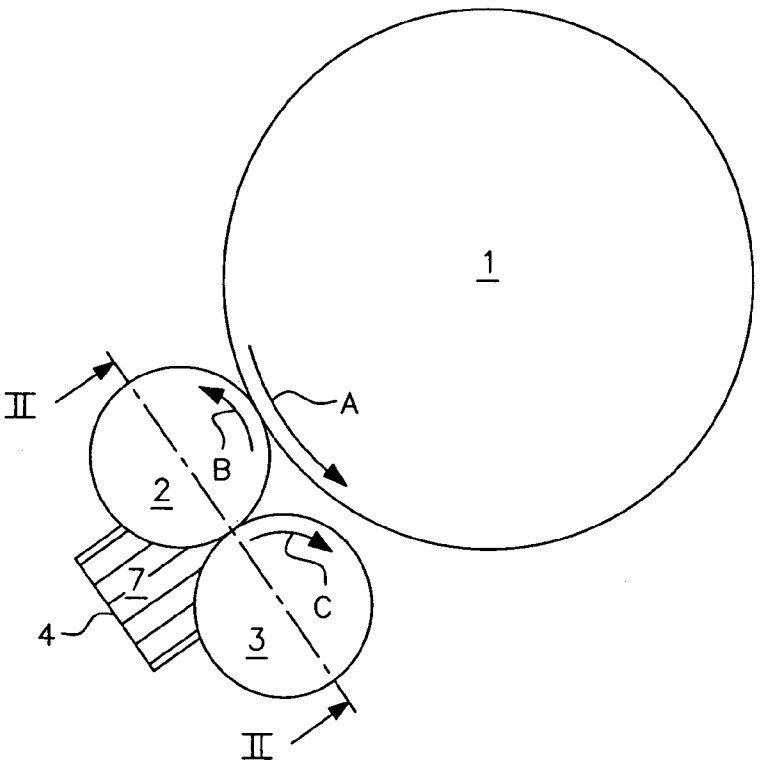
FIG. 1 Top view of a paste unit according to the invention

FIG. 1 shows a top view of a paste unit according to the invention. The glue 7 is located in a glue body 4, and is taken off by the glue application roller 2 and transferred to the making roller 1. The metering roller 3 ensures that the glue 7 is not discharged unintentionally from the glue body 4. The direction of rotation C of the metering roller 3 can be reversed, while it generally makes no sense to change the directions of rotation A and B of the making roller 1, or the glue application roller 2, respectively.

Figure 2:
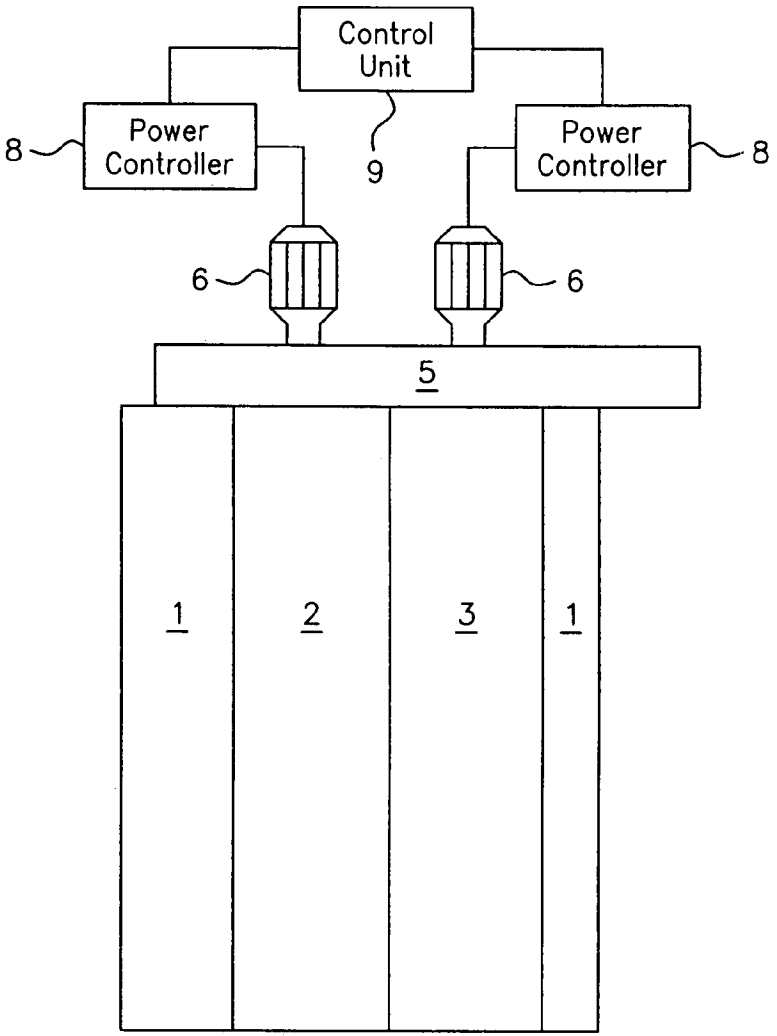
FIG. 2 Side view of the paste unit according to section line II—II in FIG. 1

FIG. 2 shows the section II—II in FIG. 1. The glue application roller 2 and the metering roller 3 are supported in a base plate suspended on one end. Two electric motors 6 are attached above the base plate 5, the drive shafts of which activate the axes of each of the two said rollers. The base plate 5, like the making roller 1, is attached in the machine rack in a manner which is not illustrated. The circumference speeds of the rollers 2, 3 can be adjusted according to the specifications of the glue transfer and glue application by means of the electric motors 6, which are supplied with current by means of power controllers 8 that can be activated via a control unit 9.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A paste unit for a bottom guide device for gluing of bottom warps or star seal bottom bags, comprising:

a glue reservoir;

a metering roller connected with the glue reservoir;

a glue application roller adjacent the metering roller;

a making roller connected to the glue application roller which transfers glue from said glue application roller to the bottom warps or the star seal bottoms; and drive mechanisms assigned to said rollers, said drive mechanisms including drive motors for adjusting a circumference speed of said metering roller independently of said glue application roller and said making roller for controlling a glue application amount;

said drive mechanisms being activated by a control device that adjusts, responsive to glue application amounts or changes in glue application amounts, circumference speeds of the metering, glue application and making rollers and aligns them to one another.

2. The paste unit according to claim 1, wherein a direction of rotation of the metering roller can be reversed.

3. The paste unit according to claim 1, wherein said glue application roller has its own individual drive motor.

4. The paste unit according to claim 1, wherein said drive motors are supplied with current by a power controller.

5. The paste unit according to claim 1, wherein the control device bases the adjustment and alignment of the circumference speeds of the rollers on a circumference speed of the making roller.

6. A method for controlling a glue application amount for a paste unit of a bottom guide device for gluing bottom warps or star seal bottoms and including a glue reservoir, a metering roller connected to the glue reservoir, a glue application roller which may be connected to the glue reservoir, and a making roller connected to the glue application roller which transfers glue from the glue application roller to the bottom warps or to the star seal bottoms, said method comprising:

assigning drive mechanisms to the metering roller, the glue application roller and the making roller; and varying a ratio of circumference speeds of the glue application roller and the making roller for controlling the glue application amount.

7. The method according to claim 6, wherein said drive mechanisms are activated using a control device, said control device adjusting said roller circumference speeds and aligning them with one another.

8. The method according to claim 7, wherein said control device, in adjusting said roller circumference speeds, starts with a pre-adjusted circumference speed of said making roller.

9. The method according to claim 6, further comprising the step of adjusting the circumference speed of said metering roller to obtain a sealing effect.

10. A method for controlling a glue application amount for a paste unit of a bottom guide device for gluing bottom warps or star seal bottoms and including a glue reservoir, a metering roller connected to the glue reservoir, a glue application roller adjacent the glue reservoir, a making roller connected to the glue application roller which transfers glue from the glue application roller to the bottom warps or to the star seal bottoms, and drive mechanisms assigned to the rollers, said method comprising:

adjusting a circumference speed of said metering roller independently of said glue application roller and said making roller such that a ratio of said metering roller circumference speed to a circumference speed of said glue application roller is varied for controlling a glue application amount.

11. The method according to claim 10, wherein said metering roller circumference speed is adjusted using a corresponding drive mechanism activated by a control device.

* * * * *